US008720091B1

(12) United States Patent
Snyder

(10) Patent No.: US 8,720,091 B1
(45) Date of Patent: May 13, 2014

(54) THREE-DIMENSIONAL MARKETING DISPLAY

(76) Inventor: Robert George Snyder, Woodstock, GA (US)

( * ) Notice: Subject to any disclaimer, the term of this patent is extended or adjusted under 35 U.S.C. 154(b) by 0 days.

(21) Appl. No.: 13/373,492

(22) Filed: Nov. 16, 2011

Related U.S. Application Data

(60) Provisional application No. 61/415,305, filed on Nov. 18, 2010, provisional application No. 61/419,815, filed on Dec. 4, 2010, provisional application No. 61/419,851, filed on Dec. 5, 2010, provisional application No. 61/429,158, filed on Jan. 2, 2011.

(51) Int. Cl.
*G09F 15/00* (2006.01)
*G09F 15/02* (2006.01)

(52) U.S. Cl.
USPC ..... 40/607.01; 40/607.03; 40/607.11; 40/610; 211/163

(58) Field of Classification Search
USPC ..... 40/607.01, 607.03, 607.11, 610; 211/163
See application file for complete search history.

(56) References Cited

U.S. PATENT DOCUMENTS

| | | | | | |
|---|---|---|---|---|---|
| 2,726,803 | A | * | 12/1955 | Ketler | 229/5.5 |
| 3,671,738 | A | | 6/1972 | Beachley | |
| 4,662,096 | A | * | 5/1987 | Bayless et al. | 40/607.03 |
| 5,096,073 | A | * | 3/1992 | O'Brien | 211/163 |
| 5,249,771 | A | * | 10/1993 | Wear | 248/317 |
| 5,257,734 | A | * | 11/1993 | Bartle | 229/109 |
| 5,606,815 | A | * | 3/1997 | Feldwhere | 40/607.03 |
| 6,321,493 | B1 | * | 11/2001 | Rillie et al. | 52/200 |
| 6,345,458 | B1 | * | 2/2002 | Garibian | 40/506 |
| 7,930,989 | B2 | * | 4/2011 | Doty et al. | 116/22 A |
| 2007/0116515 | A1 | | 5/2007 | Woytowich et al. | |
| 2008/0000192 | A1 | | 1/2008 | McGlinch | |

* cited by examiner

*Primary Examiner* — Syed A Islam
(74) *Attorney, Agent, or Firm* — Rodgers & Rodgers

(57) ABSTRACT

A three-dimensional marking display to partially enclose conventional outdoor lighting poles whereby the display includes a circular or multisided wrap having a top affixed to the upper edge of the wrap and a bottom affixed to the lower edge of the wrap for attachment to the upright lighting pole element.

17 Claims, 18 Drawing Sheets

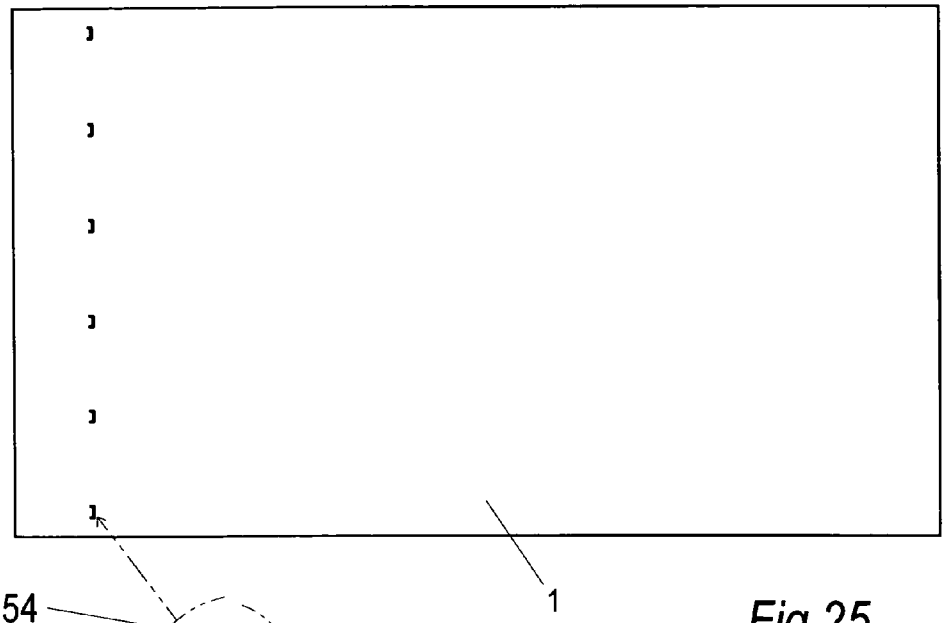
Fig 25
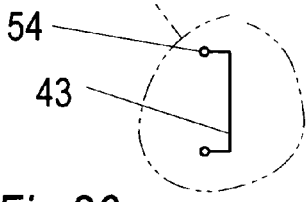
Fig 26
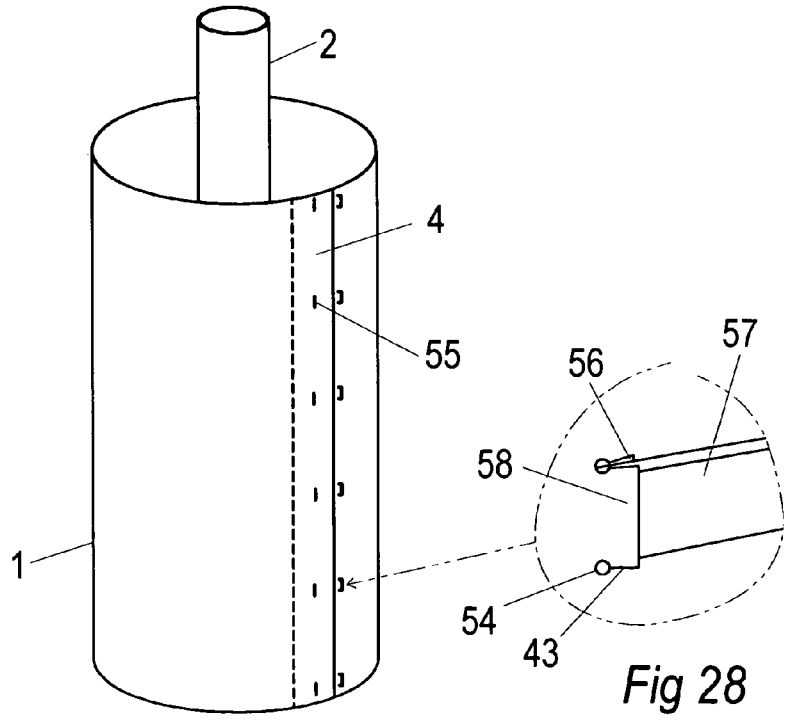
Fig 28
Fig 27

THREE-DIMENSIONAL MARKETING DISPLAY

CROSS REFERENCE TO RELATED APPLICATIONS

This application claims the benefit of the following four U.S. provisional patent applications, which are hereby incorporated by reference: Ser. No. 61/415,305 filed Nov. 18, 2010; Ser. No. 61/419,815 filed Dec. 4, 2010; Ser. No. 61/419,851 filed Dec. 5, 2010 and Ser. No. 61/429,158 filed Jan. 2, 2011.

BACKGROUND OF THE INVENTION

This invention relates to a system and the means for assembling three-dimensional marketing displays. More specifically, the invention relates to circular advertising displays which are installed around light poles and light pole concrete bases commonly found in commercial parking lots. These advertising displays may be circular, square or other geometric cross-sectional shape.

Light poles and other similar objects are often mounted on, encased in or otherwise supported by concrete base foundations. These foundations often extend vertically out of the surrounding pavement or ground level to form a concrete base to provide a means of preventing vehicles from inadvertently striking and damaging the light poles. The light poles and bases are widely used to support light fixtures to illuminate parking lots of retail stores and employee parking or operational yards at industrial location. These poles and bases create opportunities for advertising, marketing or communications messaging. The pole or base can provide structural support for the display and protection from vehicle damage to an otherwise stand-alone sign.

One method of creating a three-dimensional marketing display is by wrapping the base with a printed semi-rigid but flexible material, such as thin plastic sheet material which is taller than the base, thereby creating space available for the marketing message of greater area than if otherwise limited by the pole base height. A separate top element may be constructed from semi-rigid but flexible or similar material, such as thin plastic sheet material. Such top element may be secured to the wrap by several methods. This top element provides structural support for the extended upper edge of the printed wrap, and provides closure for the printed wrap to prevent it from collecting unwanted matter, such as blown leaves, debris or being confused as a trash receptacle. The top element may either be also fastened to the pole for additional support of the printed wrap, or may be cut short of the pole for ease in installation.

The printed wrap may follow the outside perimeter of a round base, or a square pole base. Alternatively, other cross-sectional geometries may be used for the wrap independent of the base geometry.

An alternative embodiment provides for the printed wrap to be suspended from the pole instead of being wrapped around the base. In this embodiment, the printed wrap may be supported by a top element and a bottom element, both of which are attached to the light pole.

DESCRIPTION OF RELATED ART

Planar marketing displays have been widely used attached to stationary objects such as light poles, trash cans, gasoline pumps and other fixtures. These designs require the display to be constructed from material of sufficient strength or incorporate support structures to resist undesired flexure from wind forces. When two-sided displays are used, these designs also suffer from being partially obstructed by the object to which they are mounted. This is often solved by installing two or more such displays on opposite sides of the mounting structure. These impediments create excessive manufacturing costs.

Marketing display wraps are also commonly wrapped around round barrels, stacks of automotive tires and other circular objects. In all of these designs, the printed wrap is supported directly by being wrapped snugly against or mechanically attached to the object being wrapped. As such, these displays suffer by being limited to the height of the object being wrapped.

Woytowich et al. patent application US2007/0116515 shows an invention for Protective Utility Pole Base Covers. This design suffers from multiple components required for assembly. The construction process commonly used for building light pole bases uses a round fiberboard or steel formwork to cast the concrete shape. After removing the formwork, workers commonly will cover defects in the concrete surface by rubbing the concrete with cement mortar or by applying cement stucco to the surface of the base. As such, the finished diameter of the pole base varies from pole to pole. As such, the design by Woytowich et al. suffers from having to either be custom designed for various diameters bases, or be sized to fit loosely around the base. Custom design drives the cost of manufacturing significantly, and a loose fit can cause out of plumb or moving covers.

U.S. Pat. No. 7,972,026 to Warner et al. teaches a design for a Light Pole Base Cover comprised of two components which snap together. While this invention provides a covering for the base plate of light poles mounted on concrete bases, it suffers from an intricate design of interlocking offset tabs which are expensive to manufacture.

McGlinch patent application US 2008/0000192 shows a Concrete Pole Base Cover comprised of complicated assembly of multiple components. This design suffers from high cost of manufacturing and assembling multiple components. It also suffers from size variation limitations described above for the design by Woytowich et al.

BRIEF SUMMARY OF THE INVENTION

The design of the present invention overcomes problems associated with the prior art by requiring a minimal number of components and utilizes efficient, thin and flexible material formed in circular or other geometric cross-sectional shapes for structural rigidity to resist wind forces. In the preferred embodiment, graphic art comprising a marketing or advertising message is printed on a thin, flexible sheet of material, hereinafter referred to as "wrap." The thickness of the wrap material is such that when formed in a circular or other geometric cross-section will cause the portion of the display extending above the concrete base to withstand undesired deformation from anticipated wind forces. The wrap is wrapped tightly around the concrete base of a light pole, and extends vertically above the top surface of the concrete base. The leading and trailing edges of the wrap are overlapped slightly and mechanically secured with adhesive, tape or fasteners such as staples. The design accommodates a range of variations in the diameter of the concrete base due to the overlap seam.

In a first alternative embodiment, a separate component hereinafter referred to as "top" is provided to further strengthen the extended upper edge of the wrap. The top is mechanically secured to the wrap by any well known process such as adhesive, tape or other fasteners such as staples. The top also serves to partially close down the open orifice of the display to discourage undesired use as a trash receptacle. The top may be fabricated from a planar sheet of thin flexible material, such as high density polyethylene, which is assembled in the shape of a truncated cone with an overlapped seam. The seam may be mechanically secured by use of adhesive, tape, or fasteners such as staples. The slope of the truncated cone shape and dimension of the overlap seam will vary to accommodate the range of variations in the diameter of the concrete base. A series of two or more tabs around the outside periphery of the top, which when bent to create an obtuse angle with the top, are used to secure the top to the wrapped display.

A feature of this invention includes a tab design on the top which, when bent to the obtuse angle, creates an opening in the tab to accommodate a stapling tool to be inserted through the tab to install a staple securing the tab to the wrap.

Another feature of this invention includes a series of one or more slits cut in wrap, which when wrapped around the concrete base, creates an openings in the wrap to accommodate a stapling tool to be inserted through the wrap to install a staple securing the overlapped edges of the wrap.

A variety of other tab configurations may be used for creating the overlap between the top and the wrap for the first alternative embodiment. In some designs the tabs are created on the top, and in others are created on the wrap. Access holes in either the top or wrap may be provided for inserting a stapling tool, pliers or the installer's fingers to press the tabs on the top or wrap together where adhesive is used.

In a second alternative embodiment, a the top may be molded in the form of one or more sections, with overlapped seams from a material such as thermoformed plastic.

In a third alternative embodiment, the top is secured to the upper edge of the wrap with a molding strip. In this design, the molding may either be preformed in a circular configuration or flexible to be bent by the installer in a circular shape. The truncated cone top material is slipped into a groove in the upper portion of the molding as it is formed into a circular shape or in the preformed molding. The circular formed molding with the attached truncated cone top is slipped over the upper edge of the wrap such that the wrap edge fits into a second groove in the molding. Friction fit between the molding and top, and the molding and wrap may be used to securely connect the components. Alternatively, adhesive or pointed integral barbs in the groove may be used to connect the components.

In a fourth alternative embodiment, the truncated cone top is fastened to the light pole. Tabs around the interior perimeter of the top are bent to form an acute angle between the tabs and surface of the top. One or more rubber bands, clamps, straps, or other suitable devices may be used to secure the internal bent tabs to the light pole. Various tab configurations described hereinbefore may be used to attach the outer periphery of the top to the upper edge of the wrap.

In a fifth alternative embodiment, the marketing display is elevated above the concrete base for better visibility when vehicles are parked nearby and reduce vandalism. In this embodiment, the top is constructed as described in the fourth embodiment, and an additional truncated cone component hereinafter referred to as "bottom" is similarly attached to the lower edge of the wrap and to the light pole.

BRIEF DESCRIPTION OF THE SEVERAL VIEWS OF THE DRAWINGS

FIG. 25 is a plan view of the wrap of the preferred embodiment, first alternative embodiment, third alternative embodiment, fourth alternative embodiment and fifth alternative embodiment where the connection method for the lap (not shown) uses a tool such as a stapler to install a mechanical fastener such as staples.

FIG. 26 is a detail view of the slits used for the preferred embodiment, first alternative embodiment, third alternative embodiment, fourth alternative embodiment and fifth alternative embodiment where the connection method for the lap (not shown) uses a tool such as a stapler to install a mechanical fastener such as staples.

FIG. 27 is a top perspective drawing of the present invention showing the installed wrap of the preferred embodiment, first alternative embodiment, third alternative embodiment, fourth alternative embodiment and fifth alternative embodiment where the connection method for the lap (not shown) uses a tool such as a stapler to install a mechanical fastener such as staples.

FIG. 28 is a detail view of the slits on an installed wrap used for the preferred embodiment, first alternative embodiment, third alternative embodiment, fourth alternative embodiment and fifth alternative embodiment where the connection method for the lap (not shown) uses a tool such as a stapler to install a mechanical fastener such as staples.

DETAILED DESCRIPTION OF THE INVENTION

Figure 1:
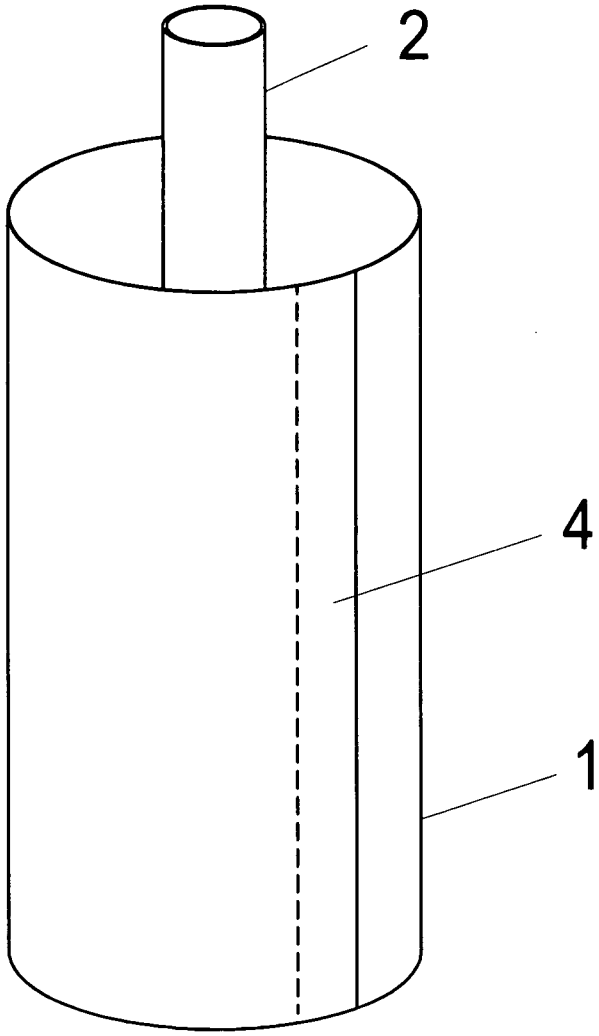
FIG. 1 is a top perspective drawing and shows the present invention in the preferred embodiment design.

FIG. 1 is a top perspective view and shows the preferred embodiment of the present invention and includes wrap 1, which may be constructed from a sheet of stiff but flexible material, such as thin polystyrene plastic. Wrap 1 is wrapped tightly around the pole base and is joined together by means of attachment flap 4. In this design, wrap 1 creates an open structure on the top side, and is not connected to pole 2. The overlapped ends of wrap 1 are secured together by mechanical attachment methods well known, such as adhesive tape, adhesive, staples, rivets or hook/loop fasteners.

Figure 2:
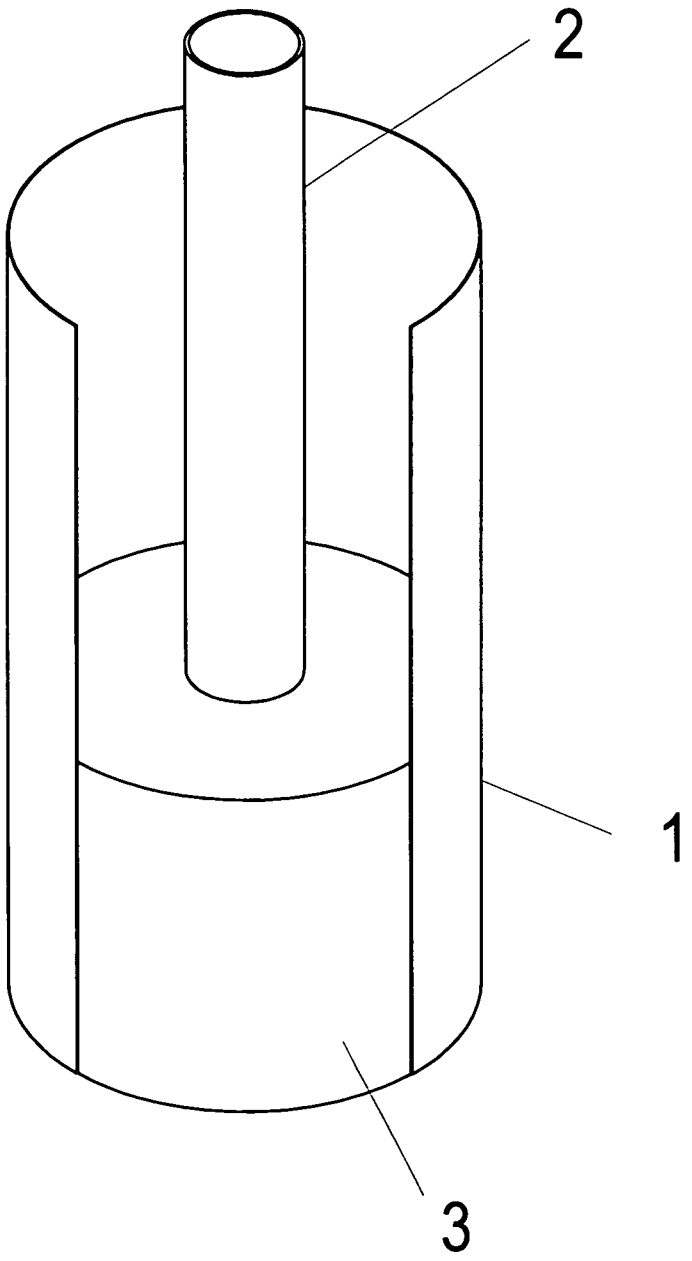
FIG. 2 is a cutaway top perspective drawing of the preferred embodiment design shown in FIG. 1 to reveal the concrete pole base.

FIG. 2 is a cutaway top perspective view of the design shown in FIG. 1 to reveal the base 3.

Figure 3:
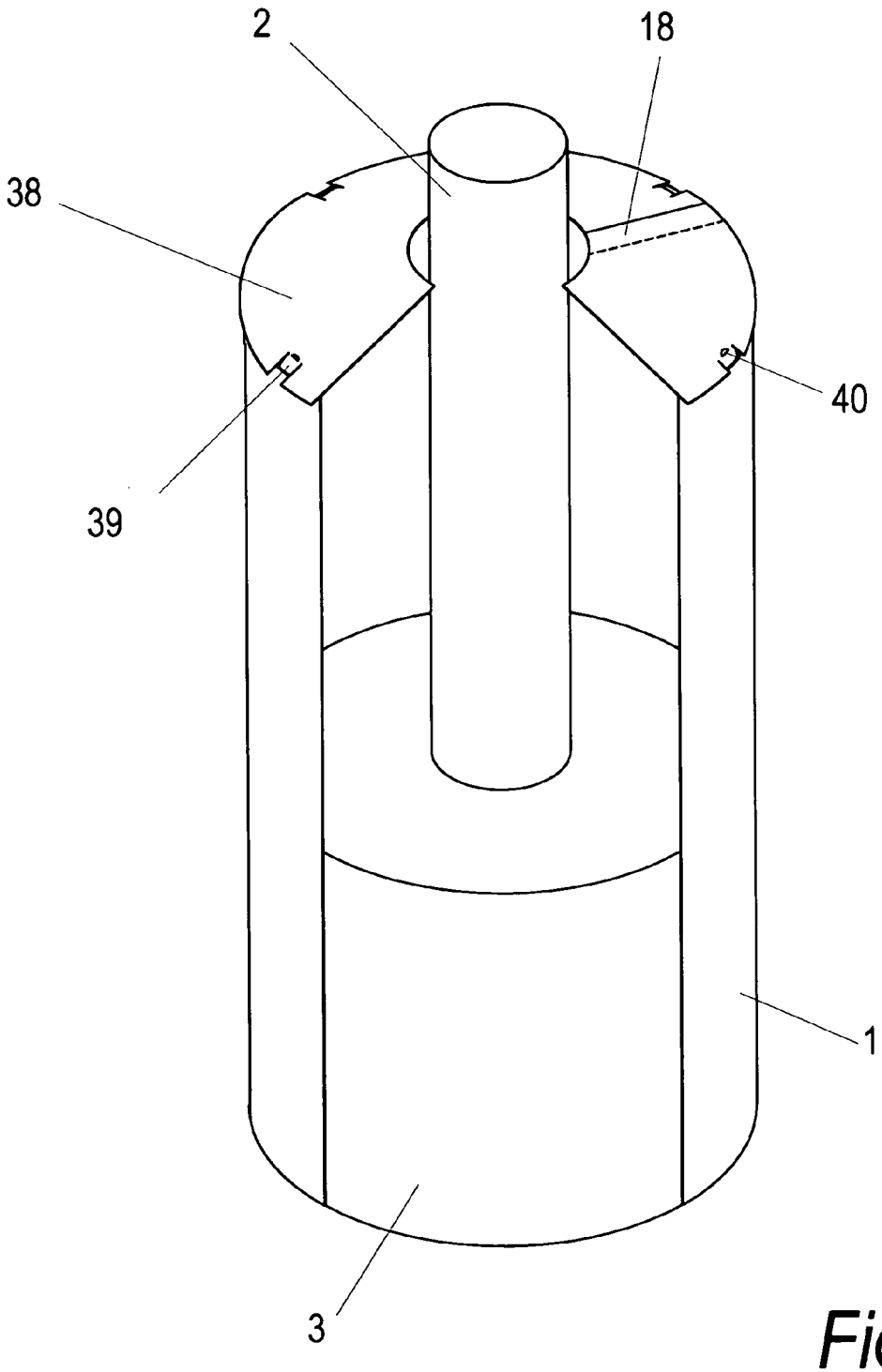
FIG. 3 is a cutaway top perspective drawing showing the first alternative embodiment.

FIG. 3 is a cutaway top perspective drawing showing the first alternative embodiment. This design is similar to that shown in FIG. 1 and includes top 38. Top 38 serves to provide lateral support for the upper edges of wrap 1. Top 38 also serves to partially or fully close off the open structure of that shown in FIG. 1. In this design, the perimeter of the top 38 has one or more tabs 39 which have been bent to an angle to align them with the upper edge of wrap 1. Hole 40 is useful to facilitate or ensure a tight connection between tab 39 and wrap 1. Suitable well known methods may be used to connect top 38 to wrap 1, such as staples, adhesive or adhesive tape. Attachment flap 18 varies in width to accommodate variations in the diameter of base 3.

Figure 4:
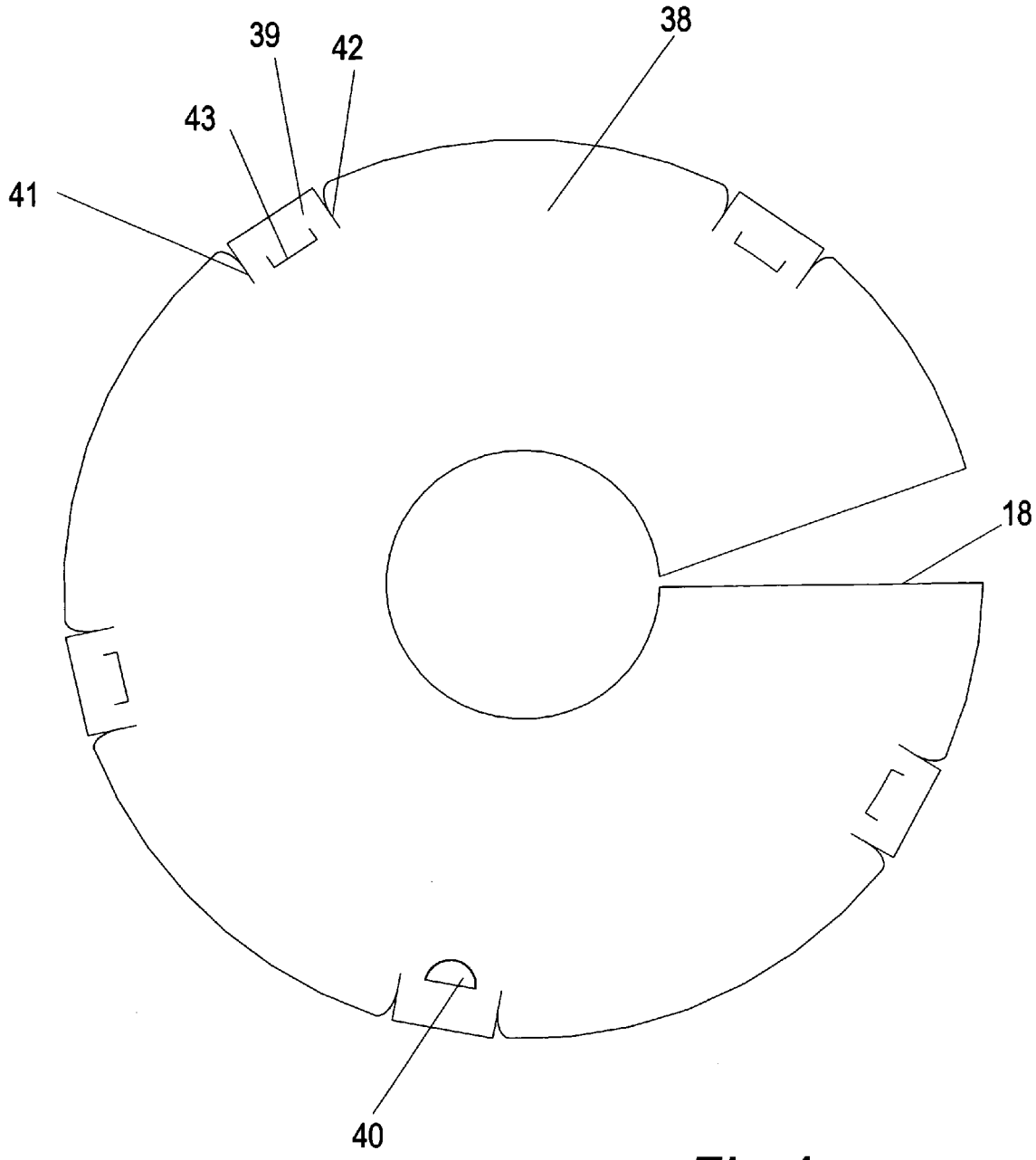
FIG. 4 is a plan view drawing of the top of the first alternative embodiment.

FIG. 4 is a plan view of the layout of top 38 of the first alternative embodiment. Top 38 is fabricated from sheet material and is subsequently rolled during installation into the form of a truncated cone to form installed top 38 as shown in FIG. 3. Slit 41 and slit 42 facilitate the bending of tab 39. Hole 40 allows for insertion of a tool or the installer's fingers to facilitate attachment to wrap 1 (not shown in this view). Alternatively, in lieu of hole 40, slit 43 may be used to create an opening for insertion of a tool or finger when tab 39 is bent downwardly.

Figure 5:
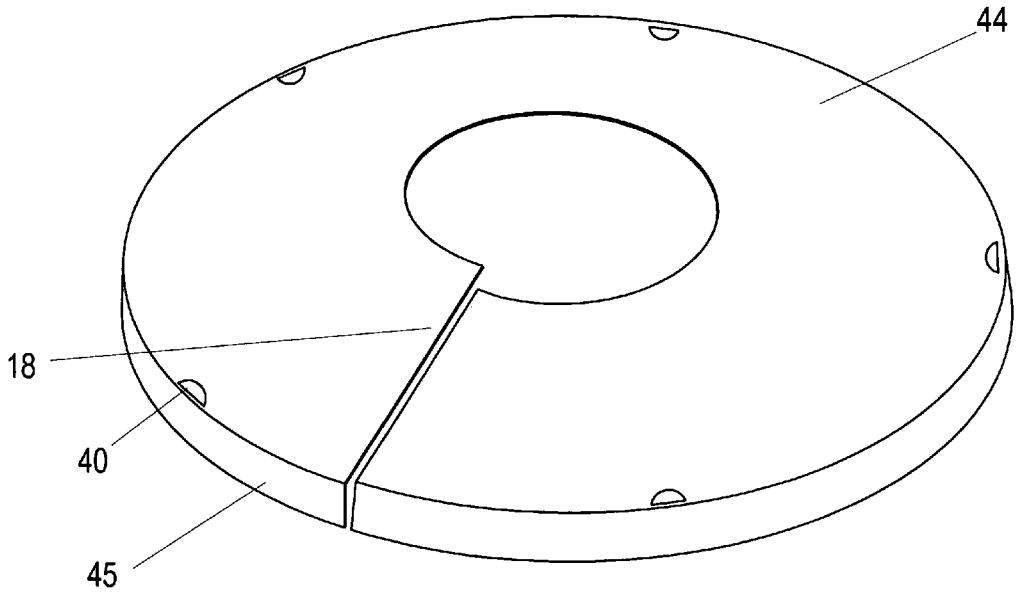
FIG. 5 is a top perspective drawing showing the design of the top component of second alternative embodiment.
Figure 8:
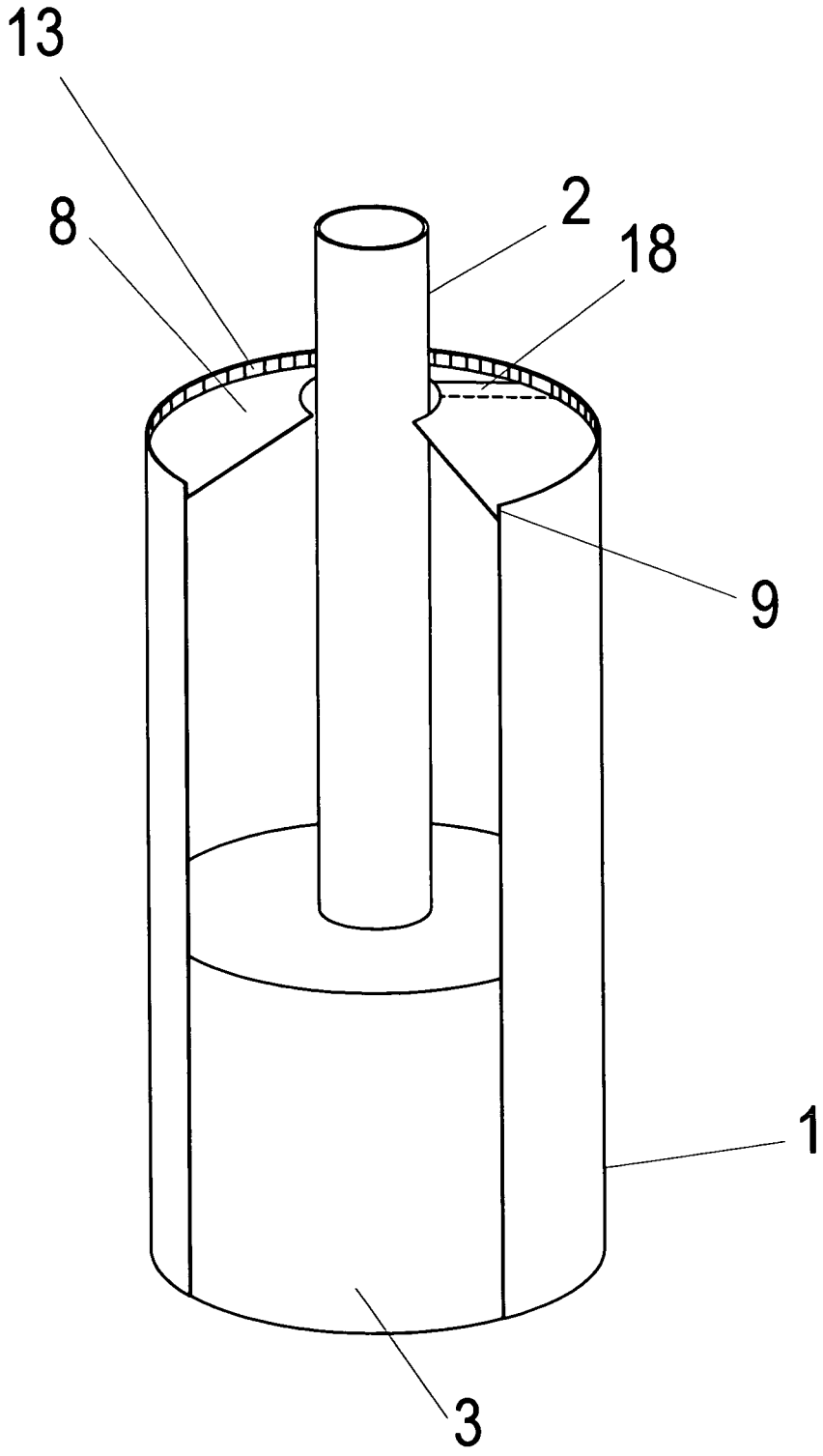
FIG. 8 is a cutaway top perspective drawing showing the assembled top and wrap for one of the various tab connection configurations.
Figure 9:
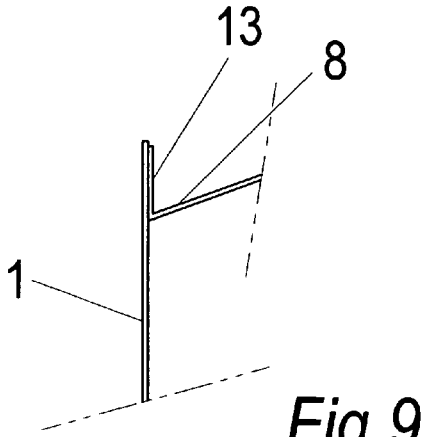
FIG. 9, FIG. 10, FIG. 11, FIG. 12 and FIG. 13 are section detail views of the various tab connection configurations for the first alternative embodiment.
Figure 10:
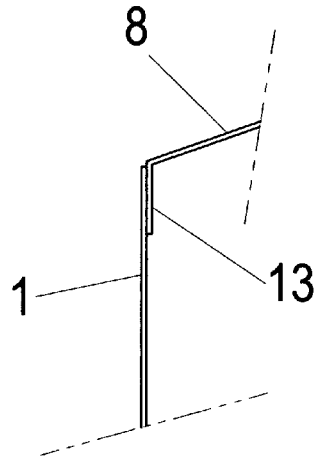
Figure 11:
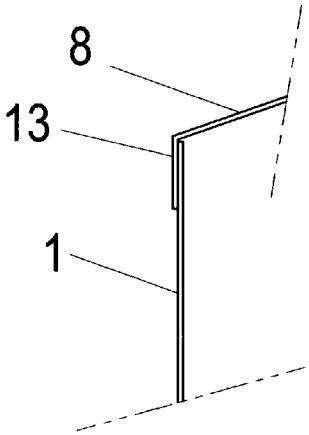

FIG. 5 is a top perspective drawing showing the design of the second alternative embodiment. It is shown slightly distorted by flexing for clarity. The distortion is continued to open up a gap between the ends of top 44 to enable installation around a pole. This design uses a three dimensional molded, cast or formed top. It may be made of thermoformed plastic, injection molded plastic or other suitable material and process. It may be made in one or more pieces (one piece is shown). It may also have any of a variety of raised or depressed rings co-centric with the center opening for stiffness. Top 44 may be aligned as shown in FIG. 10 or FIG. 11. Lip 45 may be modified with lip 45 protruding substantially vertically up (in lieu of substantially vertically down as shown) and aligned as shown in FIG. 8 and FIG. 9. Hole 40 is useful to facilitate a tight mechanical connection between lip 45 and wrap 1. Attachment flap 18 overlap is shown separated due to the distortion, but after installation will be connected by suitable connecting methods, such as staples, adhesive or adhesive tape.

Figure 6:
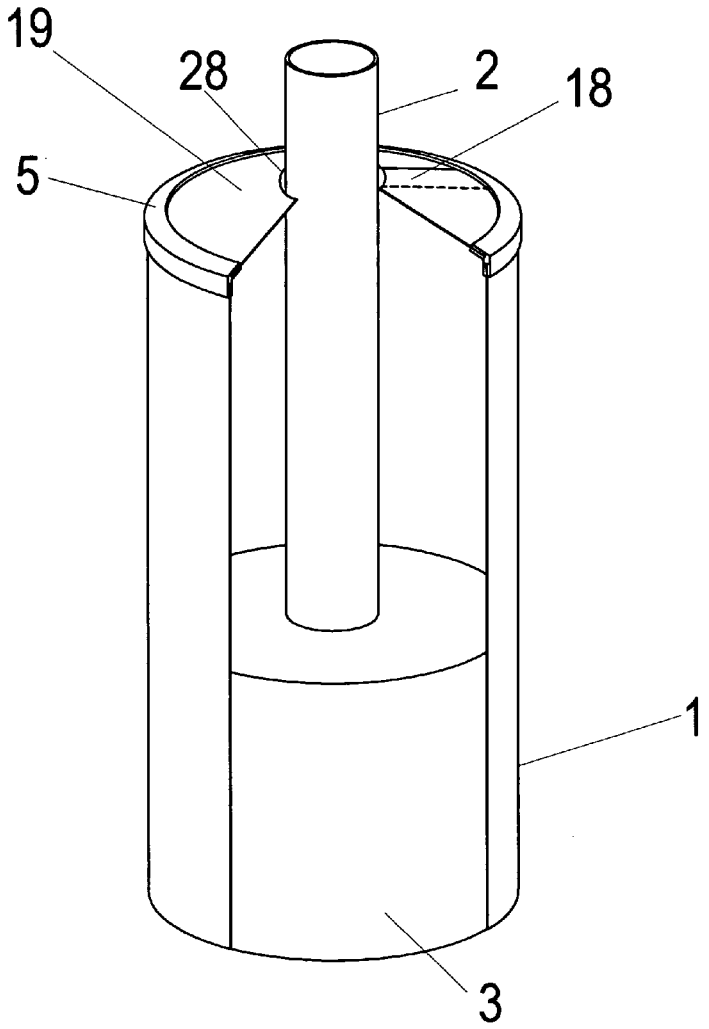
FIG. 6 is a cutaway top perspective drawing of the third alternative embodiment.
Figure 16:
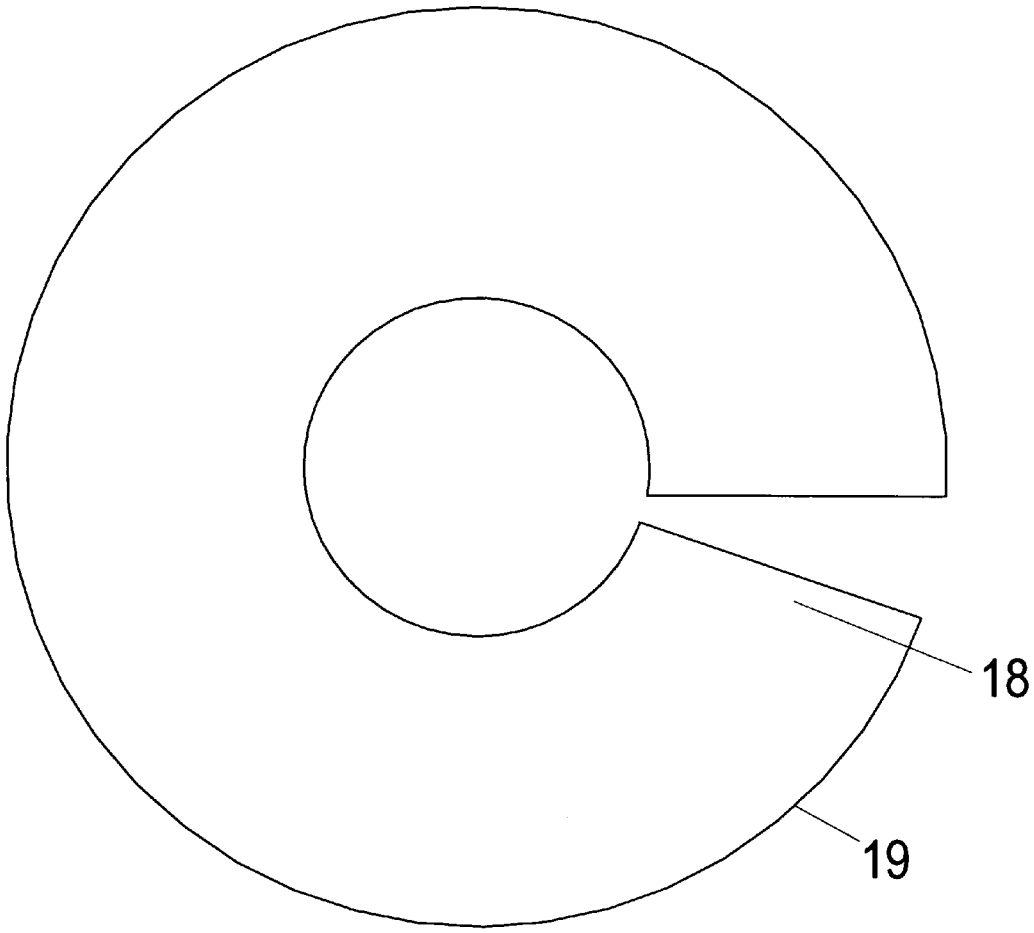
FIG. 16 is a plan view drawing of the top design which could be used with the various tab connection configurations for the first alternative embodiment shown in FIG. 12 and FIG. 13.

FIG. 6 is a cutaway top perspective drawing showing the third alternative embodiment. In this embodiment, top 8 is fabricated from a sheet of flexible material as shown in FIG. 16 and attached to wrap 1 by means of connector 5. In this design, connector 5 may be fabricated in a circular fashion shown, or it may be fabricated straight and formed during installation into the circular fashion shown.

Figure 7:
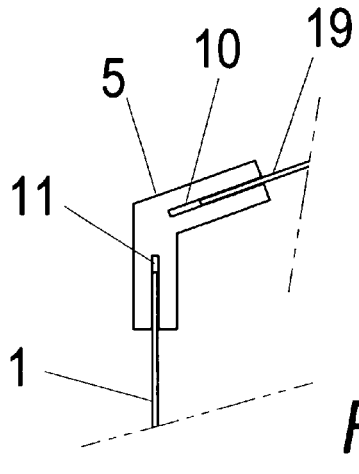
FIG. 7 is a section detail view of the molding connection of the third alternative embodiment.

FIG. 7 is a sectional detail of the connection in the third embodiment design shown in FIG. 6. Connector 5 includes slit 10 which accepts the lower edge of top 8 and slit 11 accepts the upper edge of wrap 1.

FIG. 8 is a cutaway top perspective drawing showing one of various tab configurations for connection 9 of the preferred embodiment. This design is similar to that shown in FIG. 3, except in the method of connecting top 8 and wrap 1. In this design, the perimeter of top 8 has several tabs 13 which have been bent to an angle to align with the upper edge of wrap 1. Suitable methods for connecting tab 13 and wrap 1 may be used, such as staples, adhesive or adhesive tape. A variety of other connection 9 configurations for the top 8 to wrap 1 may alternatively be used. Some of these connection configurations are shown in FIG. 9 through FIG. 13.

FIG. 9 is a sectional detail view of one of the various the tab connection configurations for the design shown in FIG. 8 for the first alternative embodiment. Tab 13 is an extension of top 8 and is attached to the upper edge of wrap 1 with adhesive, staples, adhesive tape or other well known mechanical fastening methods.

FIG. 10 is a sectional detail view of one of the various the tab connection configurations for the design shown in FIG. 8 for the first alternative embodiment. Tab 13 is an extension of top 8 and is attached to the upper edge of wrap 1 with adhesive, staples, adhesive tape or other well known mechanical fastening methods.

FIG. 11 is a sectional detail view of one of the various the tab connection configurations for the design shown in FIG. 8 for the first alternative embodiment. Tab 13 is an extension of top 8 and is attached to the upper edge of wrap 1 with adhesive, staples, adhesive tape or other well known mechanical fastening methods.

Figure 12:
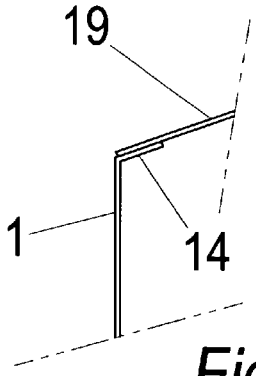

FIG. 12 is a sectional detail view of one of the various the tab connection configurations for the design shown in FIG. 8 for the first alternative embodiment. Tab 14 is an extension of wrap 1 and is attached to the perimeter edge of top 19 with adhesive, staples, adhesive tape or other well known mechanical fastening methods.

Figure 13:
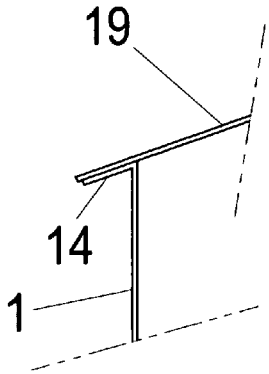

FIG. 13 is a sectional detail view of one of the various the tab connection configurations for the design shown in FIG. 8 for the first alternative embodiment. Tab 14 is an extension of wrap 1 and is attached to the perimeter edge of top 19 with adhesive, staples, adhesive tape or other well known mechanical fastening methods.

Figure 14:
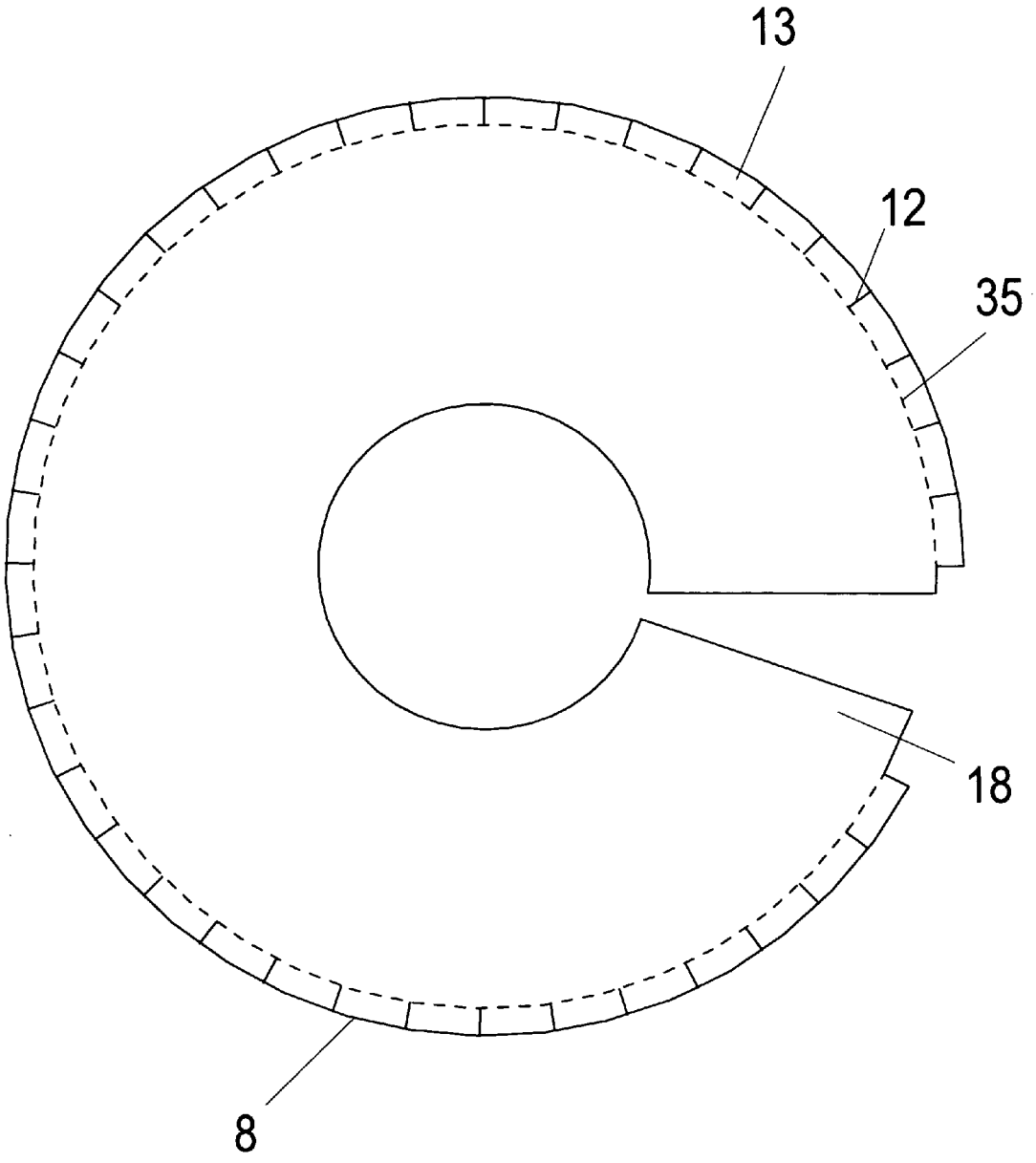
FIG. 14 is a plan view drawing of the top design which could be used with the various tab connection configurations shown in FIG. 9, FIG. 10, or FIG. 11.

FIG. 14 is a plan view drawing of the layout of top 8 for one of the various the tab connection configurations for the design shown in FIG. 8 for the first alternative embodiment. Top 8 is cut from sheet material and is subsequently rolled into the form of a truncated cone to form installed top 8 as shown in FIG. 8, FIG. 9, FIG. 10 and FIG. 11. Multiple tabs 13 are created around the perimeter of top 8 and are formed by multiple slits 12. Corresponding fold lines 35 provide the means of bending the material to the geometry necessary to connect with the wrap 1 (not shown), as shown in FIG. 8, FIG. 9, FIG. 10 and FIG. 11. Attachment flap 18 is provided for the connection of the two ends of top 8 when installed as shown in FIG. 8, FIG. 9, FIG. 10 and FIG. 11. Flap 18 is connected by a well known and suitable mechanical means, such as staple, adhesive or adhesive tape.

Figure 15:
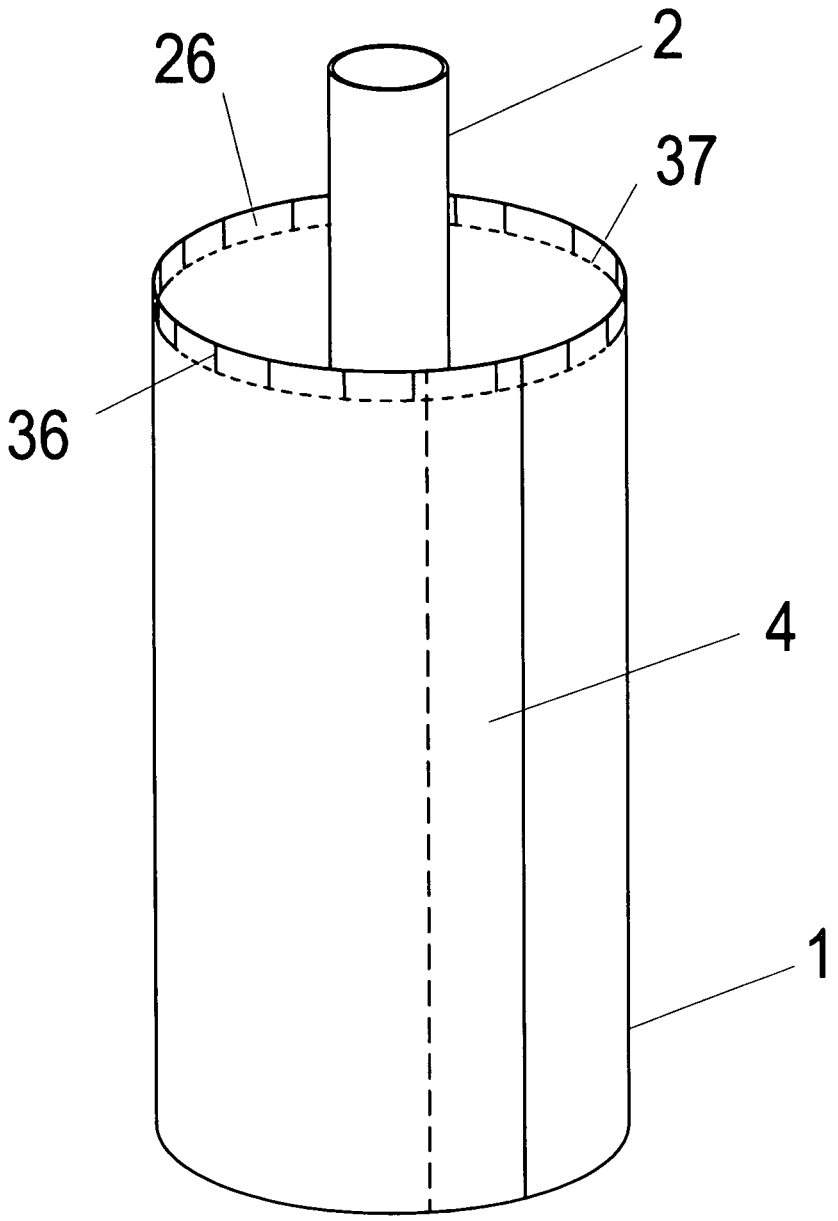
FIG. 15 is a top perspective drawing of the wrap design which could be used with the various tab connection configurations shown in FIG. 12 and FIG. 13.

FIG. 15 is a top perspective view of the wrap 1 for the first alternative embodiment shown in FIG. 12 and FIG. 13 before the top 19 (not shown) is installed. Slits 36 create several tabs 26 which are folded along the folds 37 to create the geometry necessary to connect with wrap 1 in the embodiments shown in FIG. 12 and FIG. 13.

FIG. 16 is a plan view of the layout of top 19 for the first alternative embodiment. Top 19 is cut from sheet material and is subsequently rolled into the form of a truncated cone to form installed top 19 as shown in FIG. 12 and FIG. 13.

Figure 17:
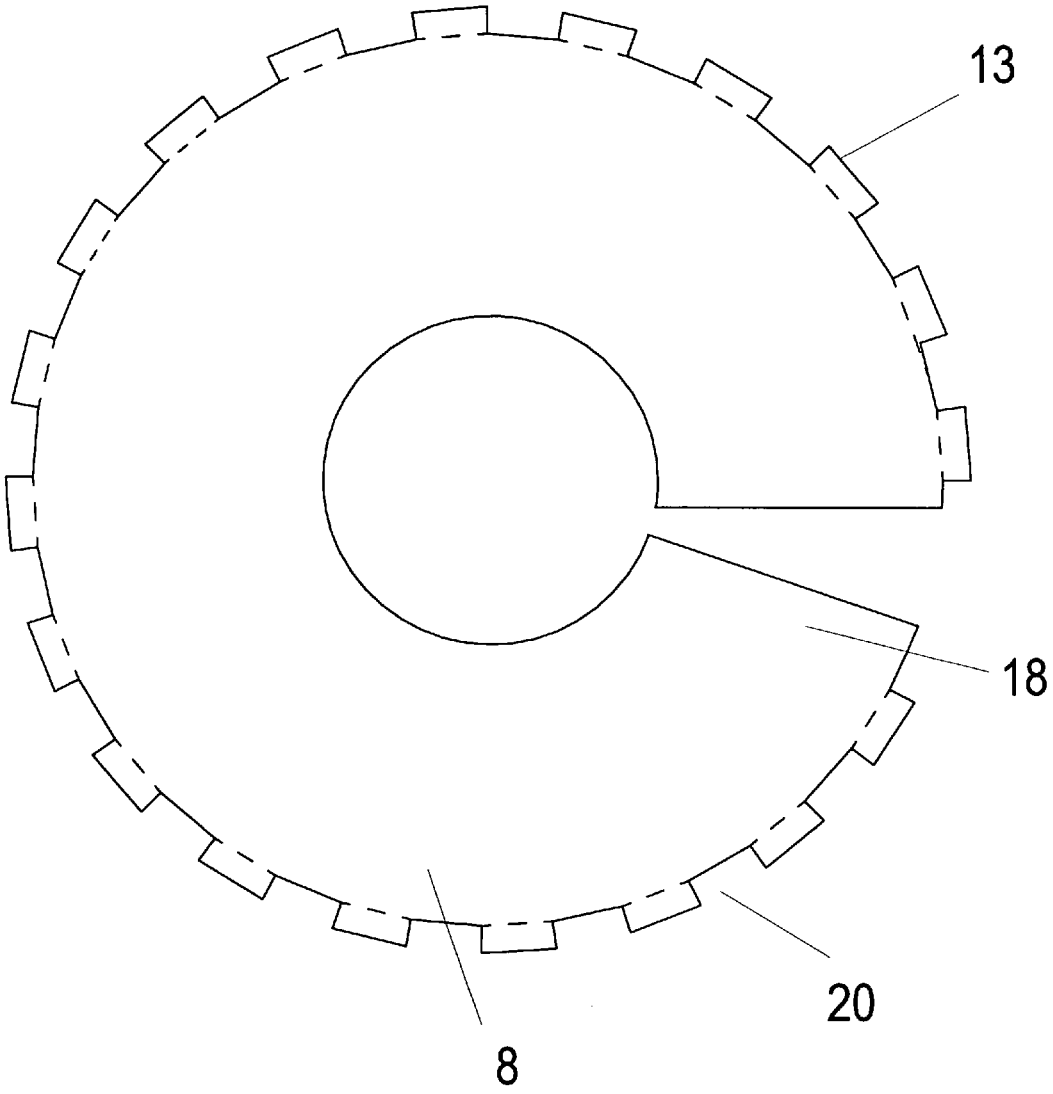
FIG. 17 is a plan view drawing of another top design which could be used with the various tab connection configurations for the first alternative embodiment shown in FIG. 9, FIG. 10, or FIG. 11.

FIG. 17 is a plan view of the layout of top 8 for the first alternative embodiment. The elements of this embodiment are similar to those the description of FIG. 14 above, except that alternate tabs 13 have been eliminated and create gaps 20.

Figure 18:
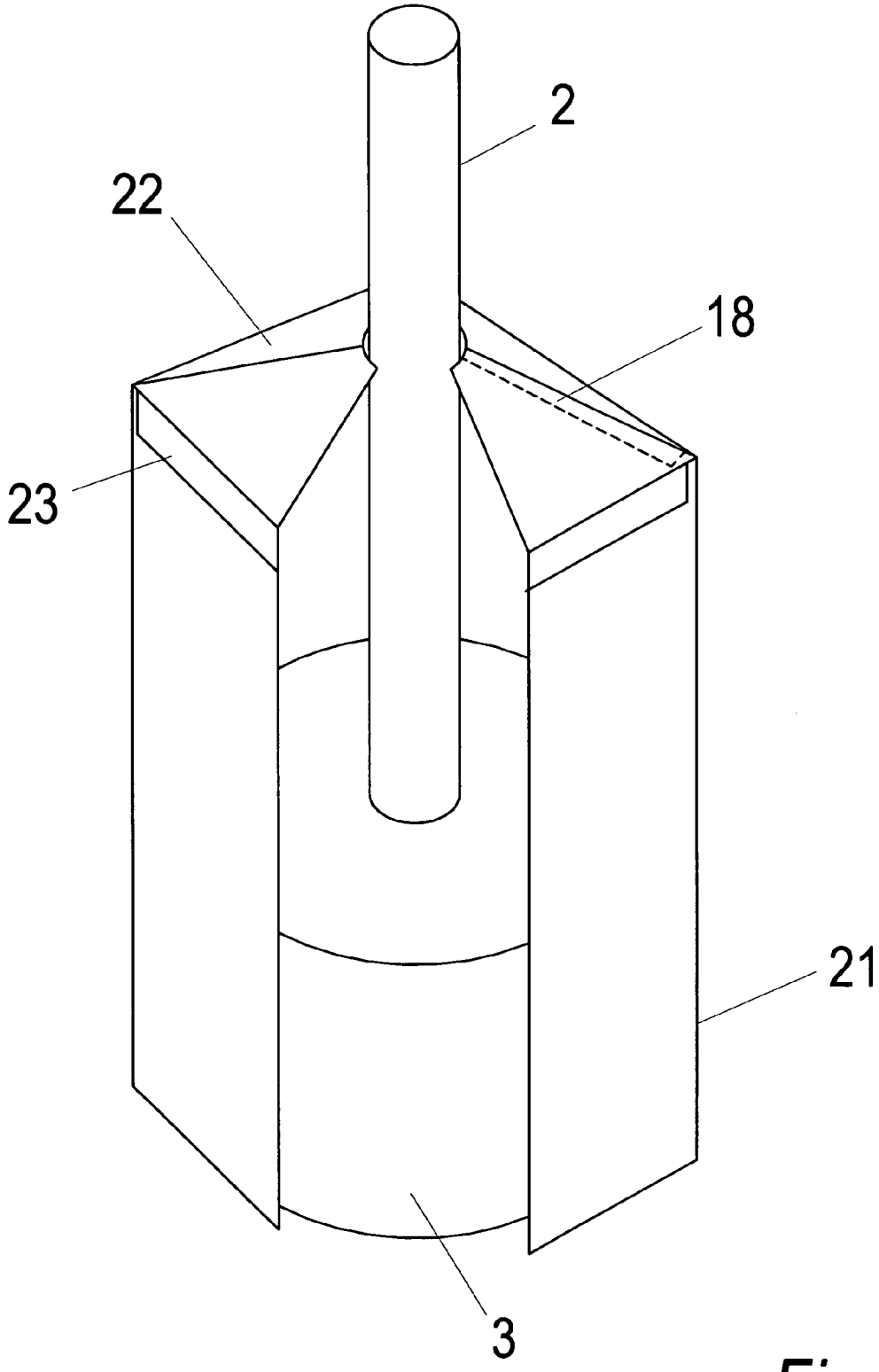
FIG. 18 is cutaway top perspective drawing showing an installed three dimensional marketing display having a square cross-sectional shape.

FIG. 18 is cutaway top perspective view showing an installed three dimensional marketing display having a square cross-sectional shape similar to the first alternative embodiment. However, in this embodiment, a four-sided wrap 21 and top 22 are shown. Tabs 23 are used to secure wrap 21 to top 22. Other embodiments include connection details shown in FIG. 7, FIG. 9, FIG. 10, FIG. 11, FIG. 12 and FIG. 13. Further embodiments include similar designs which incorporate multiple-sided wraps and tops, such as five-sided, six-sided, seven-sided, eight-sided etc.

Figure 19:
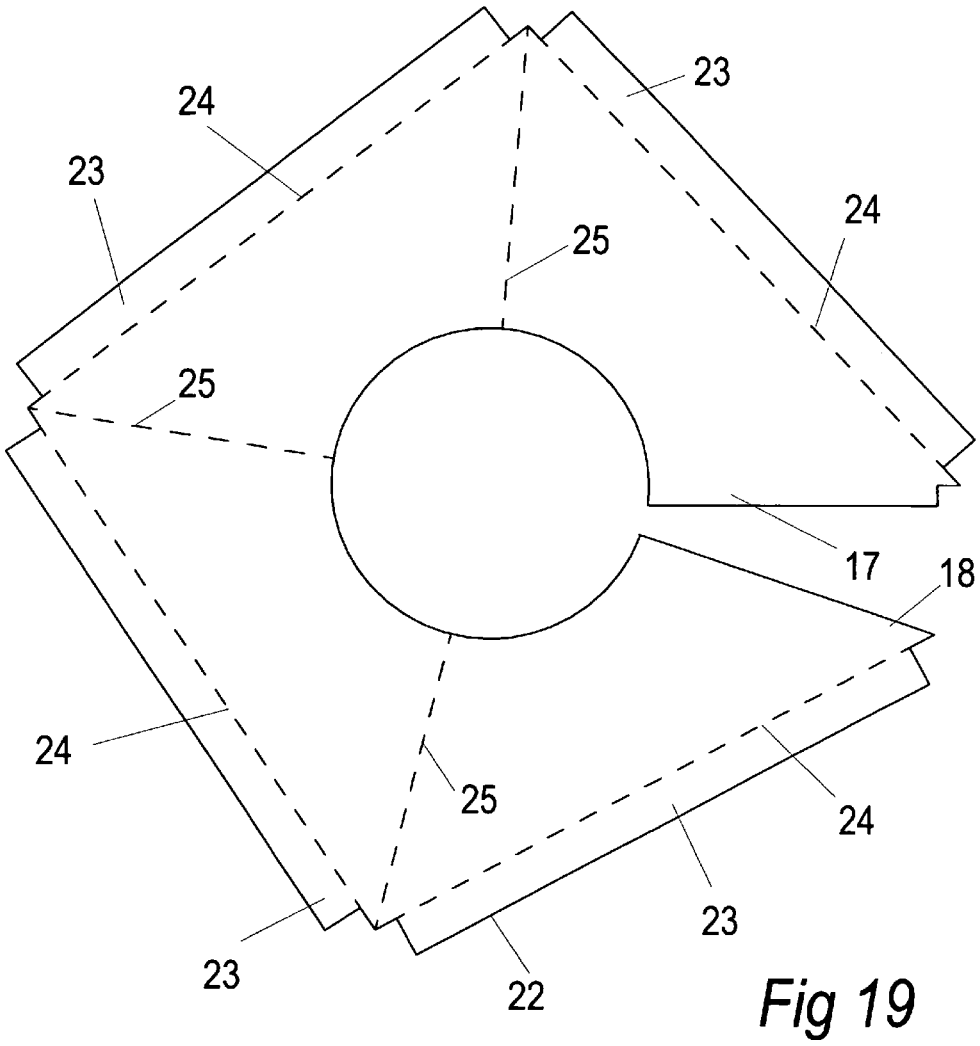
FIG. 19 is a plan view drawing of the top design which could be used with the configurations shown in FIG. 18.

FIG. 19 is a plan view of the layout of top 22 for a three dimensional marketing display having a square cross-sectional shape similar to the first alternative embodiment. Top 22 is cut from sheet material and is subsequently folded into a truncated pyramid along folds 25. Flaps 23 are created by bending the material along folds 24 to the geometry necessary to connect to wrap 21 (not shown). Further embodiments using the concept shown may be made for multiple-sided tops described above FIG. 20 is a top perspective view and shows the fifth alternative embodiment of present invention in an application where no concrete base exists. Top 47 is secured to and supported by pole 2. Top 47 has one or more tabs 51 which are connected to the pole 2 by band 7. Band 7 may be constructed from elastic material, such as latex tubing, with its ends connected by s-hooks or other suitable well known methods. Alternatively, another type of band, such as a flexible metal or plastic clamp commonly used for automobile radiator clamp, may be used. Bottom 49 is secured to and supported by pole 2 in a similar manner. The differences in the installation of top 47 and bottom 49, is tab 39 on the top 47 is bent downwards, while the tab 39 on the bottom 49 is bent upwards, so that each may be attached to wrap 1.

Figure 20:
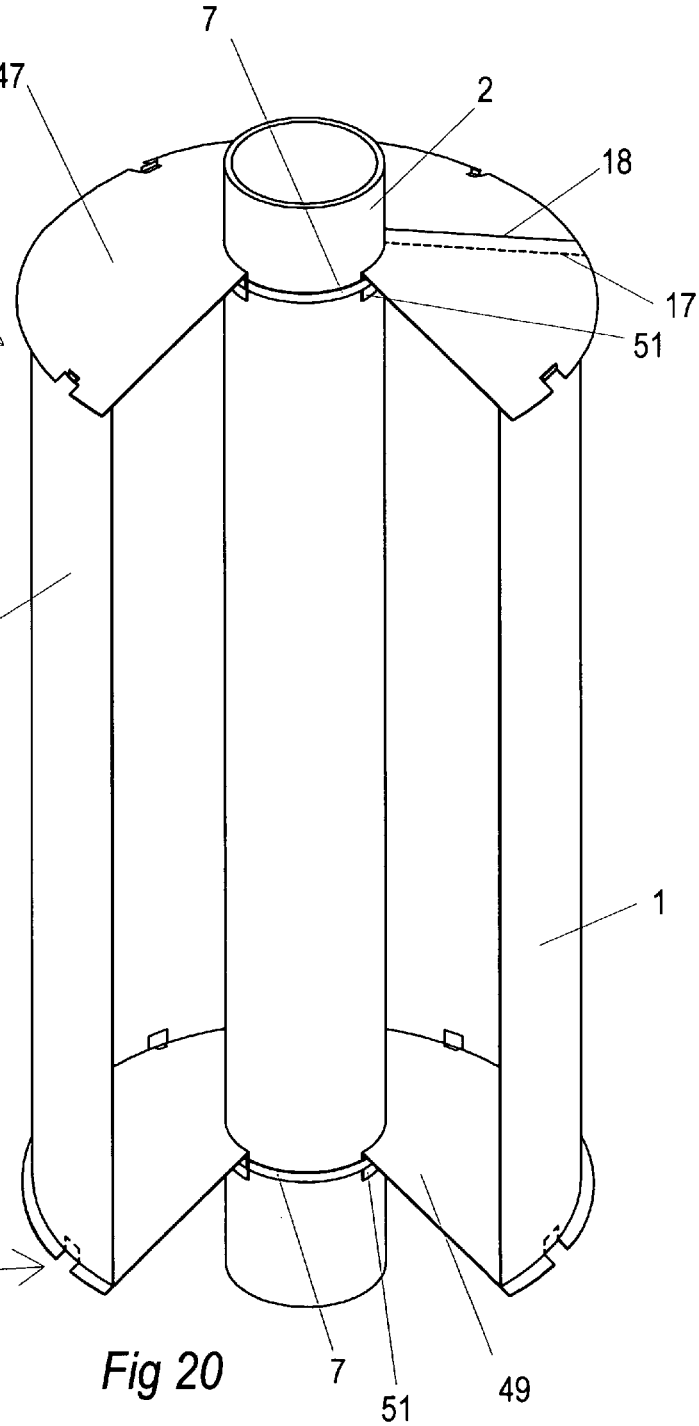
FIG. 20 is cutaway top perspective drawing of the fifth alternative embodiment.

FIG. 20 also represents the fourth alternative embodiment of the present invention in an application where a concrete base does exist (not shown) and additional lateral support for wrap 1 is desired. In this embodiment, wrap 1 is tightly wrapped around base 1 as in the preferred embodiment or as in the first alternative embodiment. Bottom 49 is omitted for this fourth alternative embodiment.

Figure 21:
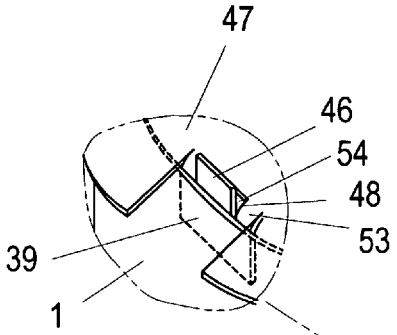
FIG. 21 is a top perspective drawing of the detail of the connection between top and wrap of the fifth alternative embodiment.

FIG. 21 is a top perspective view of the detail of the connection between top 47 and wrap 1 as shown in FIG. 20 for the fifth alternative embodiment and the fourth alternative embodiment. Tab 39 is bent downward through strap 53, causing tab 46 to rotate upwards, and creates opening 54 which is defined by slit 48. Opening 54 allows access to facilitate a method of fastening between top 47 and wrap 1 by stapling tab 39 to the upper edge of wrap 1, or for squeezing tab 39 to the top edge of wrap 1 with fingers or a tool when an adhesive or adhesive tape is placed between these two elements.

Figure 22:
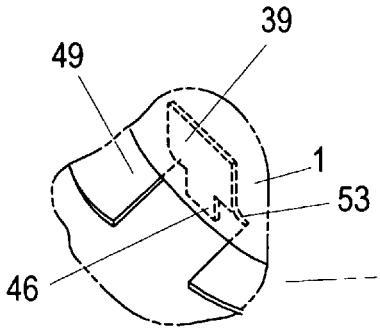
FIG. 22 is a top perspective drawing of the detail of the connection between bottom and wrap of the fifth alternative embodiment.

FIG. 22 is a top perspective drawing of the detail of the connection between bottom 49 and wrap 1 as shown in FIG. 20 for the fifth alternative embodiment. Tab 39 has been bent upward through strap 53, causing tab 46 to rotate downwards. Although not shown, opening 54 (not shown) is created similar to as described for FIG. 21 above.

Figure 23:
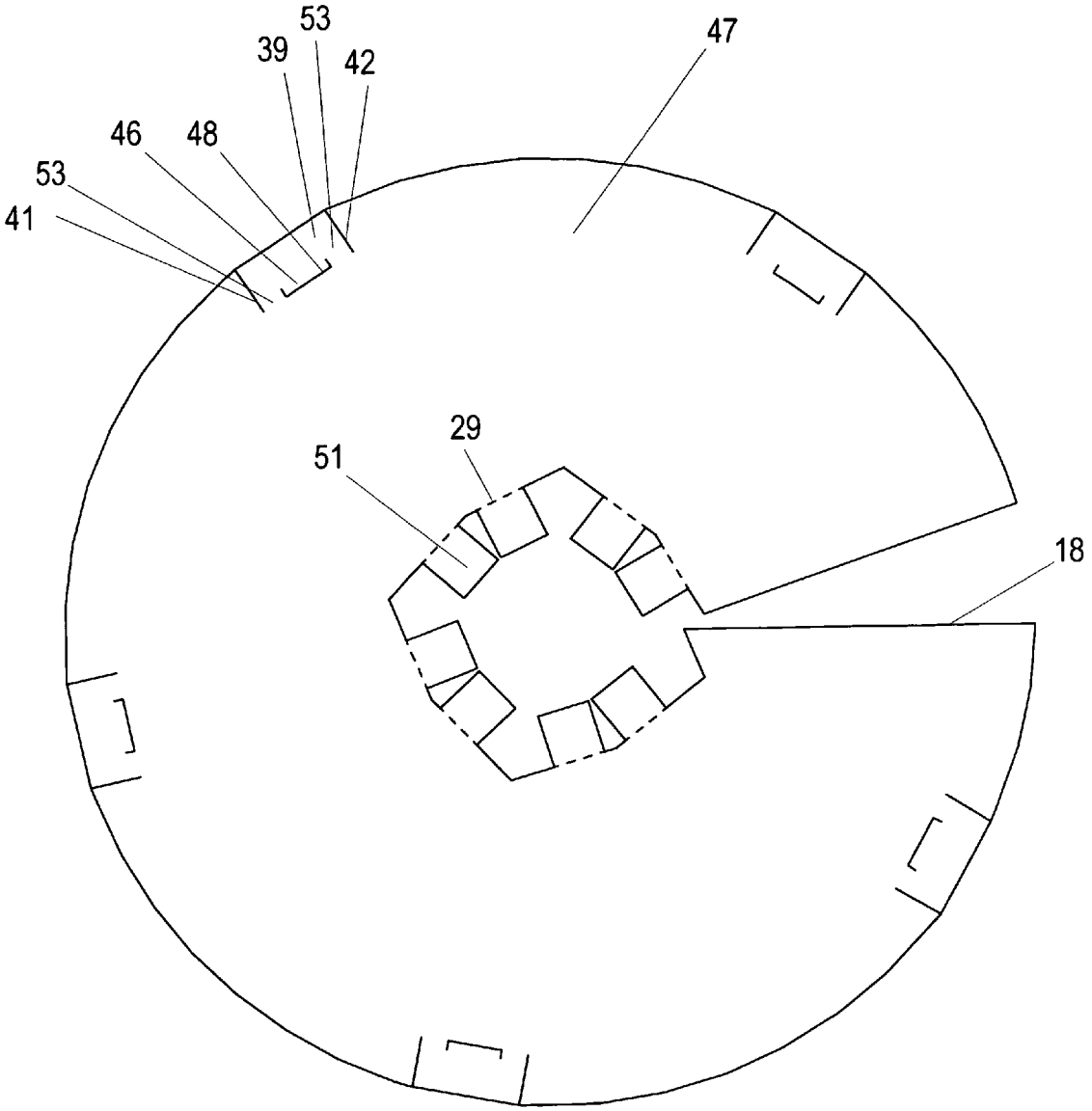
FIG. 23 is a plan view drawing of a top of the fourth alternative embodiment or top and bottom of the fifth alternative; when used on a light pole having a square cross-sectional shape.

FIG. 23 is a plan view of the layout of top 47 and bottom 49 for the fourth and fifth alternative embodiment shown in FIG. 20 when installed with a pole 2 (not shown) having a round cross sectional shape. Slit 41 and slit 42 create tab 39. Slit 48 creates tab 46. Slit 41, slit 42 and slit 48 create straps 53 which serve as hinge connection between tab 39 and top 47 or bottom 49. Tabs 51 are folded downward along folds 29. After tabs 51 are folded, the resulting shape of the center opening approximates a crude circle.

Figure 24:
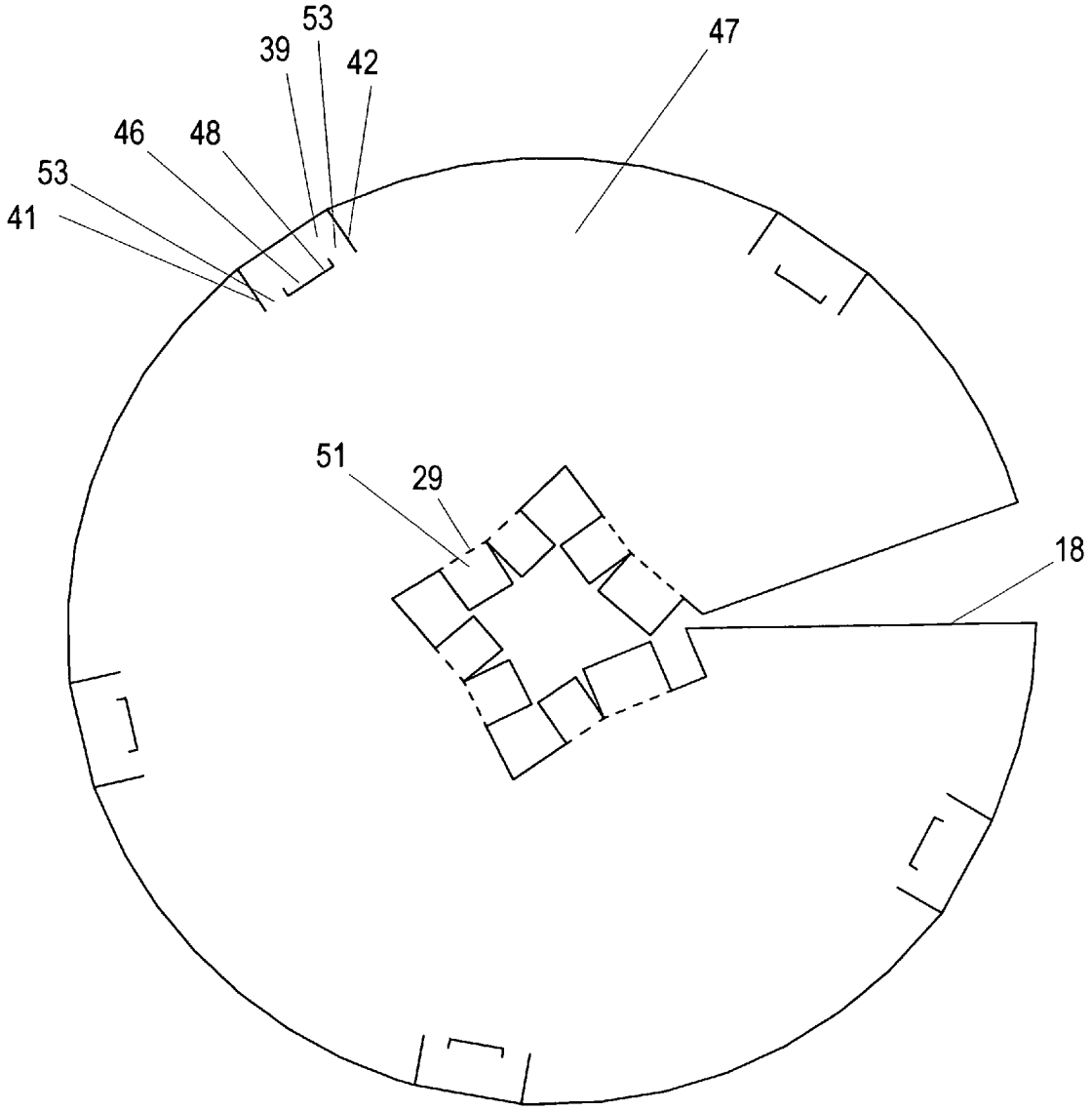
FIG. 24 is a plan view drawing of a top of the fourth alternative embodiment or top and bottom of the fifth alternative; when used on a light pole having a round cross-sectional shape.

FIG. 24 is a plan view of the layout of top 47 and bottom 49 for the fourth and fifth alternative embodiment shown in FIG. 20 when installed with a pole 2 (not shown) having a square cross sectional shape. Slit 41 and slit 42 create tab 39. Slit 48 creates tab 46. Slit 41, slit 42 and slit 48 create straps 53 which serve as hinge connection between tab 39 and top 47 or bottom 49. Tabs 51 are folded downward along folds 29. After tabs 51 are folded, the resulting shape of the center opening approximates a square.

FIG. 25 is a plan view of the wrap of the preferred embodiment, first alternative embodiment, third alternative embodiment, fourth alternative embodiment and fifth alternative embodiment where the connection method for the lap (not shown) uses a tool such as a stapler to install a mechanical fastener such as staples. Wrap 1 has one or more slits.

FIG. 26 is a detail view of the slits used for the preferred embodiment, first alternative embodiment, third alternative embodiment, fourth alternative embodiment and fifth alternative embodiment where the connection method for the lap (not shown) uses a tool such as a stapler to install a mechanical fastener such as staples. Slit 43 is terminated into hole 54 which is provides stress relief for the material of wrap 1.

FIG. 27 is a top perspective drawing of the present invention showing the installed wrap of the preferred embodiment, first alternative embodiment, third alternative embodiment, fourth alternative embodiment and fifth alternative embodiment where the connection method for the lap (not shown) uses a tool such as a stapler to install a mechanical fastener such as staples. The leading and trailing ends of wrap 1 are fastened with one or more staples 55 through lap 4.

FIG. 28 is a detail view of the slits on an installed wrap used for the preferred embodiment, first alternative embodiment, third alternative embodiment, fourth alternative embodiment and fifth alternative embodiment where the connection method for the lap (not shown) uses a tool such as a stapler to install a mechanical fastener such as staples. As wrap 1 is wrapped tightly around base 3 (not shown), tab 58 remains substantially tangent to base 3, and creates opening 56. Opening 56 permits the insertion of tool 57 which may be used to install a staple 55 or other mechanical fastener. Hole 54 provides stress relief to reduce tearing of wrap 1 caused by the insertion of tool 57 into opening 56.

The invention claimed is:

1. A three-dimensional marketing display comprising a base support, an elongated wrap of substantially circular cross-section at least partially enveloping said base support, the height of said wrap extending vertically above said base support, said wrap having an upper edge, a lop interconnected to said upper edge, said top being in the form of a truncated cone, and said base support providing structural support for said wrap.

2. A display according to claim 1 wherein said top is attached to said upper edge by one or more tabs.

3. A display according to claim 2 wherein said top comprises an outer edge and one or more openings in proximity to said outer edge to allow a tool or finger to be inserted therein.

4. A display according to claim 3 wherein said tabs are downwardly bendable.

5. A display according to claim 4 wherein said top is fabricated from one or more planar sheets of material.

6. A display according to claim 1 wherein said top is fabricated in a three-dimensional shape with a severance line formed therein.

7. A display according to claim 2 wherein said tabs are formed by spaced slits.

8. A display according to claim 1 wherein a pole extends upwardly from said base support, said top comprises one or more tabs, a band envelopes said pole, and said tabs are secured between said band and said pole.

9. A display according to claim 1 wherein said wrap is secured together with one or more fasteners by a tool inserted through openings in said wrap.

10. A display according to claim 1 whereto said top and said wrap are attached by means of a connector, said connector comprises a pair of spaced ends, a pair of slits are formed respectively in said ends, and said slits are secured respectively to said top and said wrap.

11. A three-dimensional marketing display comprising a base support, a pole extending upwardly from said base support, a multi-sided wrap at least partially enveloping said base support, the height of said wrap extending vertically above said base support, a top being interconnected to said wrap at one or more points, an aperture formed in the center of said top, said top comprising multiple sides disposed remote from said aperture, said top comprising a pair of ends formed along a severance line extending between said aperture and one of said sides, and said ends being secured in an overlapping relation.

12. A display according to claim 11 wherein said top is fabricated from a folded planar sheet of material in the shape of a truncated pyramid and having flanges to mechanically attach said top to said wrap.

13. A three-dimensional marketing display comprising a base support, a pole extending upwardly from said base support, a wrap enveloping said pole, said wrap having a top edge, a top having an outer edge and an inner edge, outer tabs integrally joined to said outer edge, said outer tabs being secured to said top edge, said inner edge being secured to said pole, inner tabs integrally joined to said inner edge, and said inner tabs disposed in face contacting relation with said pole.

14. A display according to claim 13 wherein said wrap includes a bottom edge, a bottom has an outer edge and an inner edge, tabs are integrally joined to said outer edge of said bottom, said tabs joined to said outer edge are secured to said bottom edge, and said bottom inner edge is secured to said pole.

15. A display according to claim 13 wherein said outer tabs have openings formed therein for insertion of a tool or finger.

16. A display according to claim 13 wherein said wrap has longitudinal overlapping ends, tabs are joined to one of said ends, and openings are created during bending of said tabs.

17. A display according to claim 13 wherein the disposition of said inner tabs creases a shape approximating said pole cross-section.

* * * * *